US008301403B2

(12) United States Patent
Weick

(10) Patent No.: US 8,301,403 B2
(45) Date of Patent: Oct. 30, 2012

(54) HAND HELD REFRIGERATION GAUGE

(76) Inventor: Brian K. Weick, Plainfield, IL (US)

( * ) Notice: Subject to any disclaimer, the term of this patent is extended or adjusted under 35 U.S.C. 154(b) by 383 days.

(21) Appl. No.: 12/559,137

(22) Filed: Sep. 14, 2009

(65) Prior Publication Data

US 2011/0066389 A1 Mar. 17, 2011

(51) Int. Cl.
*G06F 19/00* (2011.01)

(52) U.S. Cl. ..... 702/50; 702/45; 702/47; 702/184; 62/125; 62/126; 62/127; 62/129

(58) Field of Classification Search ..... 702/45, 702/47, 50, 184; 62/125, 126, 127, 129, 62/155, 158, 282, 82; 96/417, 421; 73/753, 73/23.2, 732, 756; 700/275, 295, 282
See application file for complete search history.

(56) References Cited

U.S. PATENT DOCUMENTS

| | | | | |
|---|---|---|---|---|
| 4,777,828 | A | 10/1988 | Ferris | |
| 5,627,770 | A | 5/1997 | Barbier | |
| 6,101,820 | A | 8/2000 | Cheballah | |
| 6,360,551 | B1 | 3/2002 | Renders | |
| 6,446,453 | B1 | 9/2002 | Trachtenberg | |
| 6,470,695 | B2 | 10/2002 | Gong | |
| 6,530,281 | B2 | 3/2003 | Chou | |
| 6,571,566 | B1 * | 6/2003 | Temple et al. | 62/129 |
| 6,668,240 | B2 * | 12/2003 | Singh et al. | 702/188 |
| 6,675,591 | B2 * | 1/2004 | Singh et al. | 62/129 |
| 6,892,546 | B2 * | 5/2005 | Singh et al. | 62/127 |
| 6,898,979 | B2 | 5/2005 | Cowan et al. | |
| 6,978,636 | B2 | 12/2005 | Motush et al. | |
| 7,024,870 | B2 * | 4/2006 | Singh et al. | 62/126 |
| 7,027,958 | B2 * | 4/2006 | Singh et al. | 702/188 |
| 7,410,257 | B2 | 8/2008 | Takeda | |
| 7,490,477 | B2 * | 2/2009 | Singh et al. | 62/129 |
| 7,644,591 | B2 * | 1/2010 | Singh et al. | 62/127 |
| 7,845,179 | B2 * | 12/2010 | Singh et al. | 62/129 |
| 8,065,886 | B2 * | 11/2011 | Singh et al. | 62/127 |
| 2002/0189267 | A1 * | 12/2002 | Singh et al. | 62/126 |
| 2002/0193970 | A1 * | 12/2002 | Singh et al. | 702/188 |
| 2003/0005710 | A1 * | 1/2003 | Singh et al. | 62/129 |
| 2004/0054506 | A1 * | 3/2004 | Singh et al. | 702/188 |
| 2004/0060305 | A1 * | 4/2004 | Singh et al. | 62/126 |
| 2004/0168463 | A1 | 9/2004 | Dudley | |
| 2005/0028539 | A1 * | 2/2005 | Singh et al. | 62/127 |
| 2005/0061008 | A1 * | 3/2005 | Ben-Nakhi et al. | 62/127 |
| 2008/0315000 | A1 * | 12/2008 | Gorthala et al. | 236/46 C |
| 2009/0037142 | A1 * | 2/2009 | Kates | 702/182 |
| 2009/0187281 | A1 * | 7/2009 | Kates | 700/275 |
| 2010/0057263 | A1 * | 3/2010 | Tutunoglu | 700/282 |
| 2010/0114380 | A1 * | 5/2010 | Kates | 700/275 |
| 2010/0179703 | A1 * | 7/2010 | Singh et al. | 700/291 |
| 2011/0054842 | A1 * | 3/2011 | Kates | 702/184 |
| 2011/0264283 | A1 * | 10/2011 | Soh et al. | 700/282 |

* cited by examiner

*Primary Examiner* — Carol Tsai
(74) *Attorney, Agent, or Firm* — Erickson Law Group, PC

(57) ABSTRACT

The present invention is a hand held gauge for use with refrigeration systems. The gauge includes a service port connector, a display screen, and user interfacing buttons. The gauge also includes electronic storage of the pressure-to-saturation temperature data for different refrigerants. The gauge allows for the measuring of temperature and pressure of refrigeration systems. After a user inputs a refrigerant type, the gauge uses the pressure and the saturation data to determine the saturation temperature. The saturation temperature is compared to the measured temperature to get the superheat or subcooling. These results may all be displayed on the display screen.

20 Claims, 4 Drawing Sheets

HAND HELD REFRIGERATION GAUGE

FIELD OF THE INVENTION

This invention relates to electronic hand held gauges, particularly for measuring pressure and temperature, particularly for refrigeration systems.

BACKGROUND OF THE INVENTION

In a common refrigeration process, a refrigerant starts in the form of a vapor at or slightly above ambient temperature. This vapor enters a compressor and exits the compressor at a high temperature and high pressure. This vapor then travels under pressure through a condenser. The condenser comprises a series of tubes that are passively cooled by air, water, or glycol. By traveling through the condenser, the vapor is brought to a lower temperature, but remains at a high pressure. Because of this, the vapor becomes a liquid. When this liquid exits the condenser and passes through a type of restriction, the pressure suddenly decreases. The evaporation and expansion of the liquid causes a large decrease in temperature and pressure. This now cold vapor passes through the tubes of an evaporator. A fan blows ambient air over the cold tubes of the evaporator, which produces cooled air.

At the liquid outlet of the condenser, it is expected that only liquid refrigerant will be present. The number of degrees that the liquid temperature is cooler than the saturation temperature corresponding to the liquid pressure is called the liquid subcooling. The subcooling is a measure of the effectiveness of the condenser and relates to proper refrigerant charge.

At the outlet of the evaporator, it is expected that only vapor refrigerant will be present. The number of degrees that the vapor temperature is warmer than the saturation temperature corresponding to the vapor pressure is called the superheat. The superheat is a measure of the effectiveness of the evaporator and relates to the refrigerant charge.

The saturation temperature, as mentioned above, corresponds to a pressure of the refrigerant. If the pressure of the refrigerant and the type of refrigerant is known, the saturation temperature may be determined. Different refrigerants have different relationships between pressure and saturation temperature, but for a given refrigerant, a chart or formula may readily express the relationship.

Therefore, in order to calculate the superheat or subcooling of a refrigeration system, a user must first know the type of refrigerant and the pressure of the refrigerant in the refrigeration system. Then the user must determine the saturation temperature using the measured pressure and the chart or formula corresponding to the known refrigerant. Then the user must measure the actual temperature of the refrigerant and compare this value to the determined saturation temperature. To determine the subcooling, the user by subtract the actual refrigerant temperature from the saturation temperature, and to determine the superheat, the user would subtract the saturation temperature from the actual refrigerant temperature.

Refrigeration systems may be provided with service ports as a means to take these measurements. These service ports may be at one or more locations to provide the user access to both the refrigerant in the condenser and the evaporator.

Hand held refrigeration gauges are known to provide refrigeration details and information to a user such as disclosed by U.S. Pat. No. 6,898,979. However, not all the necessary features for accurate subcooling and superheat determination are disclosed. The gauge disclosed does not provide a temperature sensor, but only a pressure sensor. In addition, the gauge disclosed does not provide a user interface. Also, the gauge disclosed does not provide means by which a user may interact with the operations and calculations of the gauge.

The present inventor has recognized the need for a refrigeration gauge that may be held in the hand of a user.

The present inventor has further recognized the need for a refrigeration gauge that has an easy-to-use user interface.

The present inventor has further recognized the need for a refrigeration gauge that may measure both pressure and temperature.

The present inventor has further recognized the need for a refrigeration gauge that may, given the necessary data, calculate values for superheat and/or subcooling.

The present inventor has further recognized the need for a refrigeration gauge that may accept types of input from the user.

SUMMARY OF THE INVENTION

The present invention comprises a hand held refrigeration gauge for use with a refrigeration system. The hand held refrigeration gauge includes a digital display screen on which a user may see outputs of the gauge. The outputs shown on this digital display may include, but are not limited to, temperature, pressure, saturation temperature, superheat, or subcooling. In addition, this digital display may show other information such as the current progression through the measuring and calculating process, or a notification when it is time for user input.

In one embodiment, the gauge has at least one probe that measures pressure and temperature. One probe can be used to, at different times or simultaneously, measure both pressure and temperature. Alternatively, two probes may be included on the hand held gauge, with one measuring pressure and the other measuring temperature. These values may then be displayed on the digital display screen of the hand held gauge.

The present invention also includes a processor for performing calculations such as subcooling and superheat and RAM for storing input and output data. This processor comprises taking a user input of refrigeration type. In addition, a measurement of the pressure of the vapor or liquid is made. Also, a chart or formula corresponding to the given refrigeration type is referenced, and a saturation temperature is determined. Furthermore, a measurement of the temperature of the vapor or liquid is made. Then, if a value of subcooling is desired, the measured temperature is subtracted from the saturation temperature. Alternatively, if a value of superheat is desired, the saturation temperature is subtracted from the measured temperature. These values may then be displayed on the digital display screen of the hand held gauge.

The present invention also includes at least one button or other information transferring mechanism that allows the user to control elements of the internal process of the hand held gauge. This may comprise a button to switch between performing a calculation of superheat or subcooling. In addition, this may comprise a number of buttons to select what type of refrigerant is being used, A menu button may bring up a list of refrigerants on the digital display screen, and up and down buttons as well as a select button would allow for the choosing of a refrigerant type.

DETAILED DESCRIPTION

Figure 1:
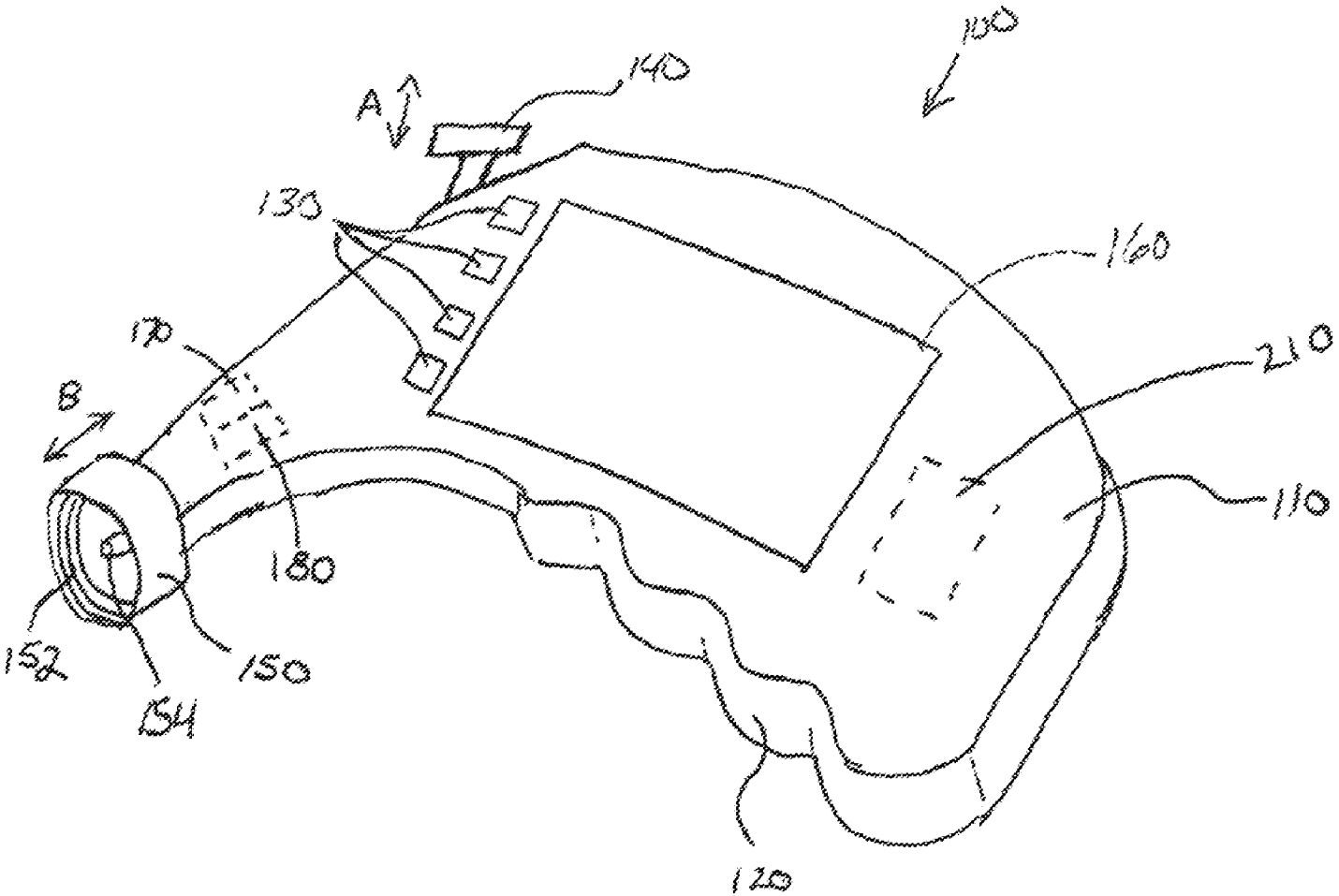
FIG. 1 is a perspective view of the hand held refrigeration gauge of the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 shows the preferred embodiment of the hand held refrigeration gauge 100 of the present invention. The gauge has a body 110, a digital display screen 160, function buttons 130, a read button 140, a hand grip 120, and a service port connector 150.

The service port connector 150 is for engaging a service port of a refrigeration or air conditioning system. In operation, the service port connector 150 is fitted onto the service port of a refrigeration or air conditioning system to be measured so as to guide the refrigerant pressure and/or temperature from the service port into the gauge 100. The service port has a seal not shown) for sealing the connection between the service port connector 150 and the service port. Pressure and/or temperature is measured upon depression of the operation function button 140. The pressure or temperature may be displayed on the digital display screen 160, by way of a processor 210 of the gauge 100.

In one embodiment, the gauge 100 has a projection 154 for engaging a shrader valve on the service port of the system that the gauge 100 is connected. The read button 140 is electronically or mechanically connected to the projection 154. The read button 140 has a withdrawn position and a read position. The projection 154 has a withdrawn position and a read position, corresponding to the withdrawn position and the read position of the read button 140. The read button 140 is movable in the A direction and the projection 154 is movable in the B direction. When the button 140 is pressed downward to the read position, the projection 154 is pressed downward and when the service port connector 150 is engaged with a service port, the projection 154 will engage a shrader valve of the service port to allow pressure to enter the gauge 100.

The body 110 contains a pressure sensor 170 in fluid communication with the service port connector 150. The pressure sensor 170 is responsive to pressure at the service port connector 150 to generate an electrical output representative of the pressure at service port connector 150.

In one embodiment, the pressure sensor 170 is a mechanical device that measures pressure mechanically and displays the results digitally, such as disclosed in U.S. Pat. No. 6,530,281, which is herein incorporated by reference. In another embodiment, the pressure sensor 170 is an electronic pressure transducer, such as a piezosensor, that generates an electrical signal in response to the pressure to which the transducer is exposed, such as disclosed in U.S. Pat. No. 7,410,257, which is herein incorporated by reference. The electrical signal is then presented on the digital display screen 160 by way of processor 210.

In one embodiment, gauge 100 has a temperature sensor 180. Temperature sensor 180 may, like pressure sensor 170, be in fluid communication with the service port connector 150. The temperature sensor 180 is responsive to temperature at the service port connector 150 to generate an electrical output representative of the temperature at service port connector 150. Whenever the refrigerant is released to be exposed to the pressure sensor 170 by means of service port connector 150, the refrigerant may also be exposed to a temperature sensor 180. However the gauge is not required to measure the pressure in order to measure temperature; either function may operate separately or in concert. Temperature sensor 180 may be in the same or a different location as pressure sensor 170.

Figure 3:
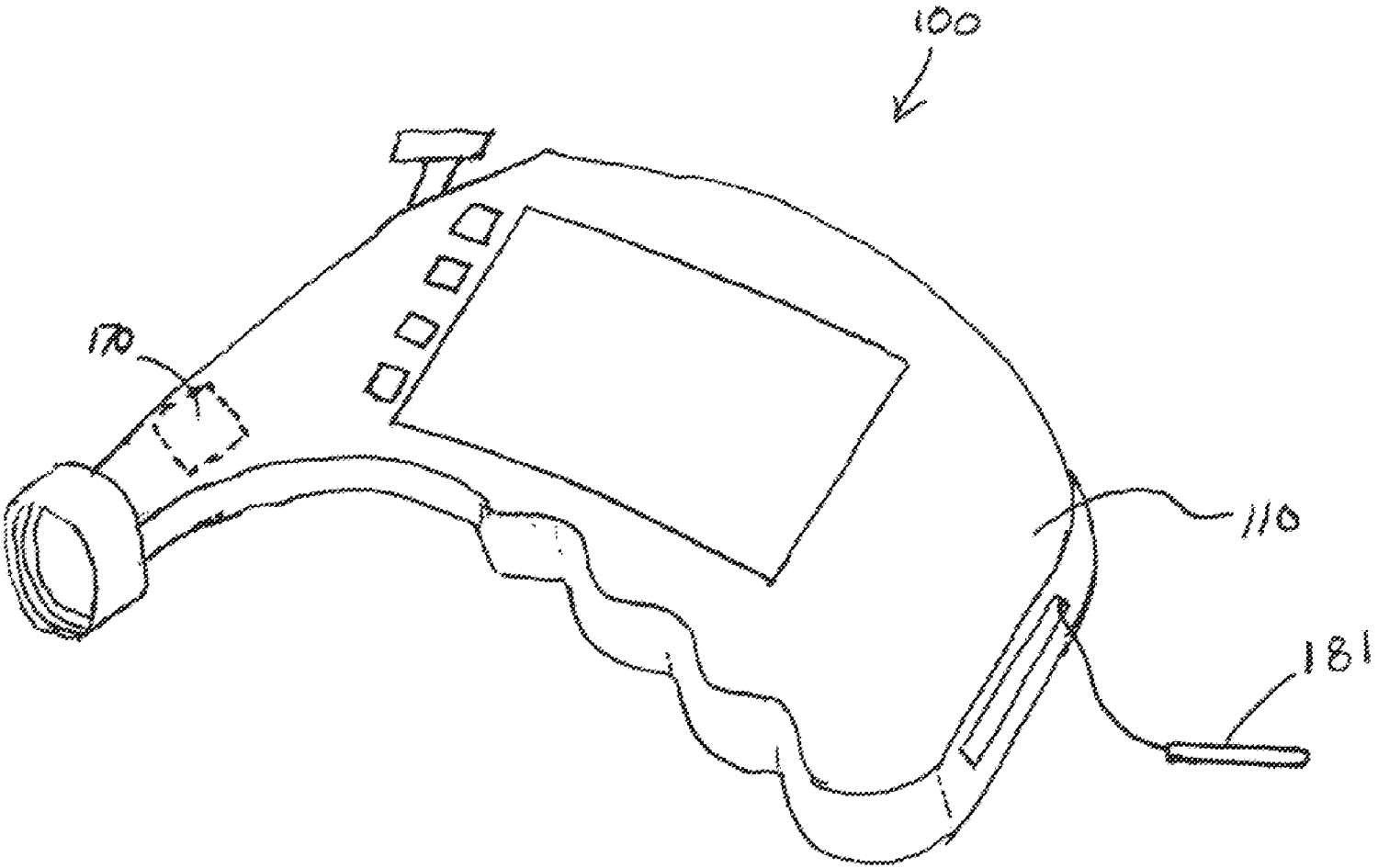
FIG. 3 is a perspective view of another embodiment of the hand held refrigeration gauge of the present invention.

In another embodiment, shown in FIG. 3, the temperature sensor 181 is attached or enclosed in a compartment of the body 110. The temperature sensor 181 is attached to the gauge 100. The temperature sensor 181 is detachable from the body 110 so that a user may connect or touch the temperature sensor 181 to a component of the air conditioning or refrigeration system being measured.

Figure 2:
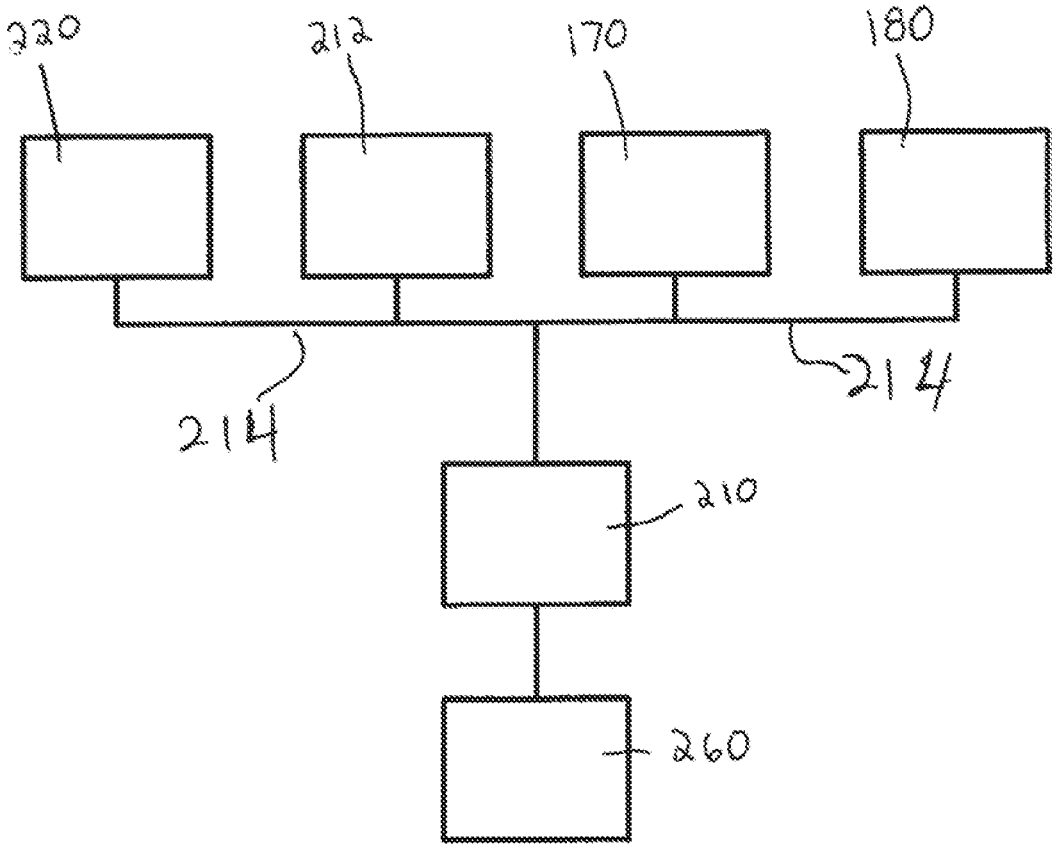
FIG. 2 is a schematic view of the internal processes of the present invention.

As shown in FIG. 2, the pressure sensor 170 and temperature sensor 180 send signals to a processor 210. A signal from a user input device 212 may also be sent to the processor 210. User input device 212 is operable to detect commands from a user at the device. User input device 212 could include a button, such as function buttons 130, a keypad, a touch screen, a stylus, a microphone, and/or any other appropriate device. Processor 210 is typically responsible for responding to the commands.

The processor 210 is operable to receive signals, analyze them, and generate representative signals as the output 260 to be sent to the display screen 160. Processor 210 may, for example, accomplish this by determining a set of pulses that represent the signals from the pressure sensor 170 or temperature sensor 180.

The processor 210 may also make calculations using the data provided by the sensors and inputs. One of such calculations is the superheat and/or subcooling of the refrigeration system. In order to calculate these values, the processor 210 calculates the saturation temperature and actual temperature of the refrigerant. To do so, the processor 210 takes as an input the pressure of the refrigerant. The processor 210 also contains an electronic data storage 220 which contains known relationships between pressure and saturation temperature for different refrigerants. The data can be in the form of a pressure-to-saturation temperature table or coefficients for a polynomial or other type of equation, for one or more particular types of refrigerants. Based on the coefficients the processor can determine the saturated temperature as a function of the input pressure. U.S. Pat. No. 5,627,770, which is herein incorporated by reference, discloses such a pressure-to-saturation temperature table and a coefficient calculation.

The processor 210 calculates the saturation temperature of the refrigerant eased on the measured pressure and the relationship table or equation information in the storage 220. To obtain a superheat value, the processor 210 subtracts the saturation temperature from the measured temperature. Similarly, to calculate a subcooling value, the processor subtracts the actual temperature from the saturation temperature. Processor 210 may also calculate other pressure or temperature related data, such as exception reports. The processor may send one or more of these values to the digital display screen 160 as an output to the user.

Figure 4:
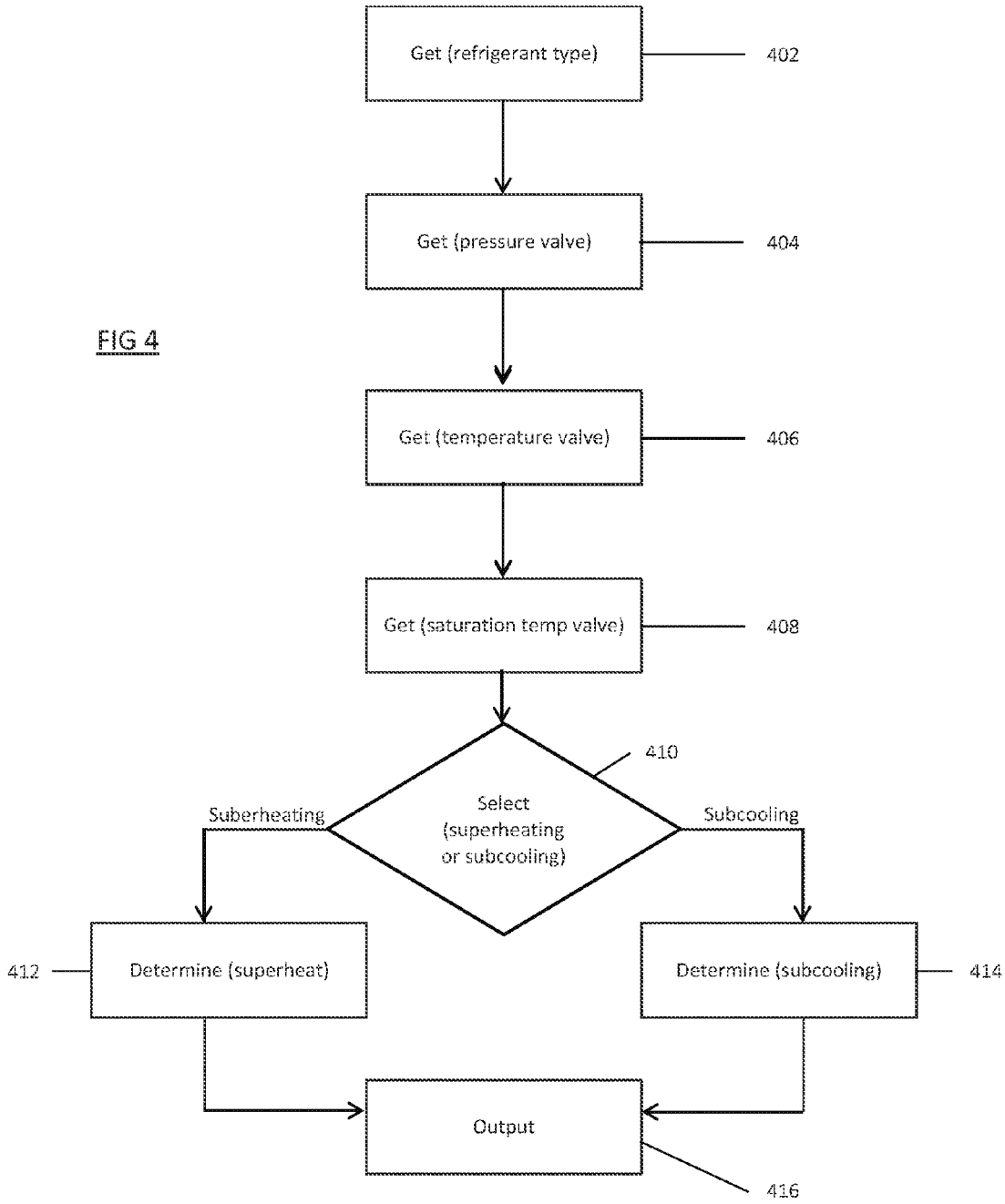
FIG. 4 is a schematic view of the superheat/subcooling calculation process of the present invention.

FIG. 4 shows one type of superheat or subcooling calculation function in more detail. At step 402, the processor or data storage receives a refrigerant type value from the user comprising the type of refrigerant to be measured. In one embodiment, the device at step 402 may also be preprogrammed to operate with one specific refrigerant such that user input at step 402 is not required. At step 404 the processor or data storage receives a pressure value corresponding to the pressure of the system being measured and received from the gauge taking the pressure measurement.

At step 406, a temperature value is received into the data storage or the processor. The temperature value may be generated by a measurement from the temperature sensor 180 or 181. Alternatively, the temperature value may be received as an input, such as from a user through function buttons 130 or through another user input 212.

At step 408 the processor references a predefined pressure-to-saturation temperature table to obtain a saturation temperature based on the refrigerant type value. The pressure-to-saturation table contains a number of saturation temperature values each corresponding to a given refrigerant type. In one embodiment, the table contains one saturation temperature value for each refrigerant type. Alternatively, in step 208 the processor data stored in the form of coefficients for a polynomial or other types of equation whereby the processor can evaluate the saturated pressure as a dependant variable, as a function of the pressure value being an independent variable. The processor at step 408 produces a value corresponding to the saturation temperature.

At step 410 the processor receives a supersub value corresponding to the desired output of superheat or subcooling. This supersub value maybe predefined or may be received as an input, such as from a user, either before or at step 410. If the supersub value corresponds to superheat, the process proceeds to step 412. If the supersub value corresponds to subcooling, the process proceeds to step 414. At step 412, the processor gauge subtracts the saturation temperature value from the measured temperature value to get a superheat output value corresponding to the difference between the refrigerant and the measured temperature. If subcooling has been selected, at step 414, the processor subtracts the measured temperature value from the saturation temperature value to get a subcooling output value, corresponding to the difference between the measured temperature and the saturation temperature. Once the output value for superheat or subcooling is determined in step 412 or step 414, respectively, step 416 is initiated. At step 416, the processor directs the output corresponding to the determined superheat or subcooling to be outputted. At step 416, the output may including the output being displayed on the display 160 or the output device 260.

The processor 210 also has instructions for calculating and displaying the proper pressure range for a particular refrigerant type based on given information, such as, the ambient air temperature, indoor wet bulb temperature, and refrigerant type. Input information necessary to calculate such information may be entered by a user using the function buttons 130 or through another user input 212.

The gauge 100 may have a user output device 260. The user output device 260 is operable to present information, whether about pressure, the device, or otherwise, to a user at the gauge 100. In one embodiment, the output device is the display 160. However, the information may be presented in visual, audible, tactile, or other appropriate format.

Although FIG. 2 illustrates the components for a refrigeration gauge, other refrigeration gauges may include less, more, and/or a different arrangement of components. For example, a refrigeration gauge may not include a user input device and/or a user output device.

In one embodiment, the display 160 comprises a pressure display area, a temperature display area, and a superheat/subcooling display area. While FIG. 1 and FIG. 2 show the display comprising one screen, various display types are encompassed within the invention. The pressure display and temperature display maybe shown by a numerical display where each digit is shown in its own LED display. Alternatively, all of the display information may be presented on a single screen, such as an LCD display.

While particular sequences are show and described herein, one skilled in the art will recognize that where a step requires information to be received from a measurement of the device or from an input by a user, the device 100 may receive that measurement or input at an earlier point in time and hold the information in a memory of the device until that information is needed by the device or a function of the device 100. The electronic components may be powered by a power source (not shown) which may comprise a battery, photovoltaic cell, or other power source. One of the function buttons 130 may operate a power button for turning the gauge on or off.

In the illustrated embodiment, the processor 210 can be implemented as a programmed general purpose computer, or a single special purpose integrated circuit (e.g., ASIC) having a main or central processor section for overall, system-level control, and separate sections dedicated to performing various different specific computations, functions and other processes under control of the central processor section. The processor 210 can be a plurality of separate dedicated or programmable integrated or other electronic circuits or devices (e.g., hardwired electronic or logic circuits such as discrete element circuits, or programmable logic devices such as PLDs, PLAs, PALs or the like). The processor 210 can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the processor 210.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A handheld gauge for measuring refrigeration characteristics of a refrigeration system, comprising:

a handheld housing, comprising, a service port connector configured to engage a service port of a refrigeration system and receive pressurized refrigerant;

a pressure sensor configured to measure a refrigerant pressure of the pressurized refrigerant physically received at the service port connector and to generate a refrigerant pressure value corresponding to the measured pressure;

a computer readable superheat portion configured to determine a superheat output value based on the refrigerant pressure value, a refrigerant temperature value, and a refrigerant saturation temperature value; and a computer readable output portion configured to output the superheat value to an output display.

2. The gauge of claim 1, comprising a temperature sensor configured to measure a temperature of the pressurized refrigerant and to generate the refrigerant temperature value.

3. The gauge of claim 1, comprising a temperature sensor configured to measure a temperature of the pressurized refrigerant and to generate the refrigerant temperature value, the temperature sensor configured to measure the temperature of the pressurized refrigerant received in through the service port connector.

4. The gauge of claim 1, wherein the computer readable superheat portion comprises instructions for calculating the superheat value based on the refrigerant temperature value and the saturation temperature value.

5. The gauge of claim 4, comprising a data storage configured to hold a number of saturation temperature values each corresponding to a given refrigerant type; and wherein the computer readable superheat portion comprises instructions for retrieving from the data storage a saturation temperature value corresponding to the refrigerant type value being measured.

6. The gauge of claim 5, comprising a computer readable subcooling portion configured to determine a subcooling output value based on a refrigerant pressure value, a refrigerant temperature value, and a refrigerant saturation temperature value, the computer readable subcooling portion has instructions for calculating the subcooling value based on the refrigerant temperature value and the saturation temperature value.

7. The gauge of claim 4, comprising: a computer readable subcooling portion configured to determine a subcooling output value based on a refrigerant pressure value, a refrigerant temperature value, and a refrigerant saturation temperature value; and a computer readable function selection portion configured to determine whether to call the subcooling portion or the superheat portion so that either a subcooling output value or a superheat output value will be generated based on a function selection input value.

8. The gauge according to claim 1, wherein said pressure sensor comprises a projection for engaging a schrader valve to release refrigerant from the refrigerant system to be measured through the service port connector.

9. The gauge according to claim 5, wherein the output portion is configured to send to the output display the refrigerant pressure value and at least one of: the refrigerant temperature value, the refrigerant saturation temperature value, superheat output value, or subcooling output value.

10. A handheld gauge for measuring refrigeration characteristics of a refrigeration system, comprising:

a handheld housing, comprising, a service port connector configured to engage a service port of a refrigeration system and receive pressurized refrigerant;

a user input configured to receive input data from a user;

a pressure sensor configured to measure a refrigerant pressure of the pressurized refrigerant received at the service port connector and to generate a refrigerant pressure value corresponding to the measured pressure;

a temperature sensor configured to measure a temperature of the pressurized refrigerant and to generate the refrigerant temperature value, the temperature sensor configured to measure the temperature of the pressurized refrigerant received in through the service port connector; and an output display configured to display to a user at least the pressure value and the temperature value.

11. The gauge of claim 10, wherein the temperature sensor configured to measure the temperature of the pressurized refrigerant received in through the service port connector.

12. The gauge of claim 10, comprising a computer readable superheat portion configured to determine a superheat output value based on the refrigerant pressure value, a refrigerant temperature value, and a refrigerant saturation temperature value.

13. The gauge of claim 10 comprising a computer readable subcooling portion configured to determine a subcooling output value based on a refrigerant pressure value, a refrigerant temperature value, and a refrigerant saturation temperature value.

14. The gauge of claim 10, comprising:

a computer readable superheat portion configured to determine a superheat output value based on the refrigerant pressure value, a refrigerant temperature value, and a refrigerant saturation temperature value;

a computer readable subcooling portion configured to determine a subcooling output value based on a refrigerant pressure value, a refrigerant temperature value, and a refrigerant saturation temperature value;

a computer readable function selection portion configured to determine whether to call the subcooling portion or the superheat portion so that either a subcooling output value or a superheat output value will be generated based on a function selection input value; and wherein the output display is configured to display the refrigerant pressure value and at least one of: the refrigerant temperature value, the refrigerant saturation temperature value, the superheat output value, or the subcooling output value.

15. The gauge of claim 10, comprising a data storage configured to hold a plurality of saturation temperature values each corresponding to a given refrigerant type; and a computer readable data storage retrieval portion configured to retrieve a saturation temperature value corresponding to the refrigerant type value being measured.

16. The gauge of claim 10, wherein the input data comprises at least one of a refrigerant type value, a saturation temperature value, refrigerant temperature value, or an ambient air temperature value.

17. The gauge of claim 10, comprising a data storage configured to hold a plurality of normal pressure ranges each corresponding to a given refrigerant type;

a computer readable data storage retrieval portion configured to retrieve a pressure range corresponding to the refrigerant type value being measured by the gauge; and wherein the output configured to display the pressure range corresponding to the refrigerant type value being measured.

18. A handheld refrigeration pressure gauge, comprising:

a handheld housing, comprising, a service port connector configured to engage a service port of a refrigeration system and receive pressurized refrigerant;

a user input device for receiving input data from a user;

a pressure sensor for measuring a refrigerant pressure of the pressurized refrigerant received at the service port connector and to generate a refrigerant pressure value corresponding to the measured pressure;

a temperature sensor for measuring a refrigerant temperature of the pressurized refrigerant and to generate the refrigerant temperature value corresponding to the refrigerant temperature, the temperature sensor configured to measure the temperature of the pressurized refrigerant received in through the service port connector;

a computer readable subcooling portion for determining a subcooling output value based on the refrigerant pressure value, the refrigerant temperature value, and the refrigerant saturation temperature value, and an output display for outputting to a user at least the subcooling output value.

19. The gauge of claim 18, comprising:

a computer readable superheat portion for determining a superheat output value based on the refrigerant pressure value, a refrigerant temperature value, and a refrigerant saturation temperature value;

a computer readable function selection portion for determining whether to call the subcooling portion or the superheat portion so that either a subcooling output value or a superheat output value will be generated; and wherein the output display is for displaying the refrigerant pressure value and at least one of: the refrigerant temperature value, the refrigerant saturation temperature value, superheat output value, or subcooling output value.

20. The gauge of claim 18, wherein the input data comprises at least one of a refrigerant type value, a saturation temperature value, the refrigerant temperature value, or an ambient air temperature value.

* * * * *